United States Patent [19]

Lambert et al.

[11] Patent Number: 4,865,071

[45] Date of Patent: Sep. 12, 1989

[54] FLOW VALVE

[75] Inventors: Derek Lambert, Rhu, Nr. Helemsburgh; David Crowe, Alloa, both of United Kingdom

[73] Assignee: Fry's Metals Limited, London, England

[21] Appl. No.: 253,613

[22] Filed: Oct. 5, 1988

[30] Foreign Application Priority Data

Oct. 15, 1987 [GB] United Kingdom ..... 8724236

[51] Int. Cl.[4] ..... F16K 5/14

[52] U.S. Cl. ..... 137/312; 251/180; 251/184

[58] Field of Search ..... 137/312; 251/174, 309, 251/368, 180, 181, 184

[56] References Cited

U.S. PATENT DOCUMENTS

| | | | |
|---|---|---|---|
| 3,333,598 | 8/1967 | Schott | 137/312 |
| 3,537,680 | 11/1970 | Zajac | 251/174 X |
| 3,595,274 | 7/1971 | Faisandier | 251/174 X |
| 4,292,993 | 10/1981 | Felthuis et al. | 251/368 X |
| 4,337,920 | 7/1982 | Parris | 251/368 X |
| 4,650,101 | 3/1987 | Fricher | 251/174 X |

FOREIGN PATENT DOCUMENTS

| | | |
|---|---|---|
| 962936 | 7/1964 | United Kingdom . |
| 1363835 | 8/1974 | United Kingdom . |
| 1466904 | 3/1977 | United Kingdom . |
| 2064727 | 6/1981 | United Kingdom . |

*Primary Examiner*—John Fox

*Attorney, Agent, or Firm*—Watson, Cole, Grindle & Watson

[57] ABSTRACT

A flow valve comprising two valve members having contacting flat surfaces, one of the members containing spaced inlet and outlet fluid passages and the other of the valve members containing an intermediate passage, the valve members being mounted such that relative rotation of the flat surfaces can be effected to locate the intermediate passage either fully or partially in or out of communication with the inlet and outlet passages, and a channel is provided around at least part of the periphery of the contacting flat surfaces to receive molten metal and dross leaked between them.

11 Claims, 2 Drawing Sheets

FLOW VALVE

BACKGROUND OF THE INVENTION

1. Field of the Invention

The present invention relates to a flow valve for controlling a the flow of fluid and, in particular, to a flow valve suitable for controlling flow of molten metal.

2. The Prior Art

Conventional valves, for controlling the flow of molten metal include plug valves which comprise a plug positioned above a hole, the plug being raised or lowered to unblock or block the hole as desired, and taper plugs, which generally comprise a conical plug retained within a conically tapering bore provided through a pipe, the taper plug having a passage drilled through it, such that by rotation of the taper plug about its conical axis within the bore the passage can be aligned to communicate or to block the flow of metal through the pipe.

It will be appreciated that while the simplicity of construction of such valves is an advantage when dealing with hot, and possibly corrosive, fluids such as molten metal, they allow for only coarse adjustment. In particular, they are inadequate when it is desired to maintain a very accurate rate of fluid flow or to dispense only a small, but accurate, amount of fluid. There is thus a need for a flow valve capable of dispensing fluid such as molten metal in an easily controllable and accurate manner. One example of an application where such control is needed is in the manufacture of melt-out cores for use in plastics moulding where accurate core size and quality of surface finish of the core are important features. Melt-out cores are usually made of readily fusible metals such as tin, lead and their alloys. The plastic is moulded around the core, which is then melted to leave a hollow plastic moulding.

Many different, and more complicated, designs of flow valve are known for controlling the flow of fluid such as water, aqueous solutions, oils, petroleum products and gases for use in either commercial or domestic applications. One type of valve which has been used comprises two valve members, one containing spaced inlet and outlet fluid passages and the other an intermediate passage, mounted such that relative rotation of the members can be effected to locate the intermediate passage either fully or partially in or out of communication with the inlet and outlet passages. Thus, by relative rotation of the members, the flow of fluid through the valve via inlet, intermediate and outlet passages can be controlled.

Valves of this general kind are known, for example, from GB 2064727, which describes and illustrates in FIG. 1 a stop or mixing valve; GB 1466904, which relates to mixing valves for liquids or gases and illustrates in FIG. 9 a mixing valve having three inflow and outflow passages in a lower valve chamber with an upper valve disc containing transfer channels pressed against the lower valve chamber by a compression spring stop; GB 1363835, which describes a valve for use in domestic pumping, for example a faucet; and GB 962936, which describes such a valve for use in gas chromatography.

Hitherto, such valves have not been used for fluids such as molten metal. One reason for this is that such fluids present additional problems. One major problem is the production of oxides. In molten metals maintained at an elevated temperature metal oxides are frequently produced and these oxides tend to collect as a precipitate together with other dross material at joins of moving parts present in a valve. If the valve is not regularly cleaned, these precipitates will cause it to become less efficient to operate and eventually to seize up. Flow valves of the kind traditionally used for molten metal also suffer from oxide build up, but their construction is sufficiently simple to allow for easy cleaning. In the case of a more complex and closely engineered valve, the build up of oxides can be far more serious.

The present invention provides a valve which is capable of accurate flow control of molten metal and which does not need frequent dismantling to remove oxide residues.

SUMMARY OF THE INVENTION

In accordance with the present invention there is provided a flow valve comprising two valve members having contacting flat surfaces, one containing spaced inlet and outlet fluid passages and the other an intermediate passage, the valve members being mounted such that relative rotation of the flat surfaces can be effected to locate the intermediate passage either fully or partially in or out of communication with the inlet and outlet passages characterized in that a channel is provided around at least part of the periphery of the contacting flat surfaces to receive molten metal and dross, such as metal oxides, leaked between them.

It will be noted that where particles are ground between two relatively rotating surfaces, the particles tend to move outward away from the axis of rotation. Thus, oxide and other dross particles in a valve of this kind tend to move outward towards the housing and the peripheral space.

While FIG. 9 of GB No. 1466904 and FIG. 1 of GB No. 2064727 both illustrate valves in which there is a gap between an upper of two valve members and the housing of the valve to permit rotation of the upper valve member relative to the housing, they do not suggest the provision of a special channel to receive material leaked between the valve members as is the case for the present invention. Material leaked into the gap of the valve of GB 1466904 or GB 2064727 will build up in the gap between the rotating upper valve member and the housing wall, thus inhibiting free movement.

In accordance with the present invention the channel is preferably provided by a groove or recess in the housing containing the valve members. An annular groove can very easily be bored into the housing wall using conventional engineering techniques. This increases the separation of the housing from the valve members in the region of the contacting surfaces compared with the separation elsewhere and thus provides a recessed passage in which material leaked from between the valve members can collect without inhibiting free movement of either valve member within the housing.

It will be appreciated that another way to produce the channel is to provide a groove or recess in one or both of the valve members themselves at the periphery of the contracting surfaces to increase the separation from the housing in that region.

The channel will preferably extend below the plane of contact of the flat surfaces of the valve members. In this case leaked material will actually fall into the recessed passage under the influence of gravity and be removed from the vicinity of the moving valve member.

It will be appreciated that while it is comparatively simple to produce an annular peripheral channel, a peripheral channel of another shape, or even a peripheral channel which is blocked at certain points around the periphery of the contacting flat surfaces may be employed in accordance with the invention if desired. However, if the channel is blocked too often around the periphery the efficiency of oxide and dross removal will decrease. Preferably, the channel will extend around the whole of the periphery of the contacting flat surfaces.

In cases where it is expected that large quantities of leaked material, such as oxides, may occur, at least one leak port may be provided for removal of material received by the peripheral space. The leak ports may slope downwardly so that removal of the material is facilitated by gravity. If necessary, suction may be applied to the leak port or ports to aid removal of the material.

Preferably the flat surfaces of the first and second valve members each have a carbide coating such as a tungsten carbide-based coating. Oxide particles can be abrasive and since carbide coatings are generally harder than ordinary valve construction materials such as steel the presence of such coatings will improve the resistance to abrasion. Another advantage of employing a carbide coating is that such coatings can generally be polished very flat and enable the valve to be employed without added lubricant. To reduce the likelihood of leakage of material the carbide coated surfaces will be made as flat as possible and preferably will have a surface flatness of not more than 3 light bands.

To maintain the flat surfaces as close together as possible the valve members will normally be biased into contact by a spring, for example a disc spring or coil spring.

It will be appreciated that the amount of flow through the valve when it is fully open will be determined by the diameter of the inlet and outlet passages and by the diameter of the intermediate passage and by the fluid pressure. The throughput of a valve may, therefore, be controlled by changing one or both of the valve members for members having passages of different diameters. Alternatively, the diameter may be controlled by the use of one or more orifice plates. Thus, at least one of the inlet, outlet and intermediate passages may be adapted to receive an orifice plate to control the effective diameter of that, passage. If this method is adopted, the original valve members may be retained and orifice plates of a different diameter inserted according to the desired throughput. This may be preferred to changing one valve member on its own since the two valve members will tend to wear together during use.

BRIEF DESCRIPTION OF THE DRAWINGS

The present invention will now be described by way of example with reference to the accompanying drawings in which.

DETAILED DESCRIPTION OF THE PREFERRED EMBODIMENT

Figure 1:
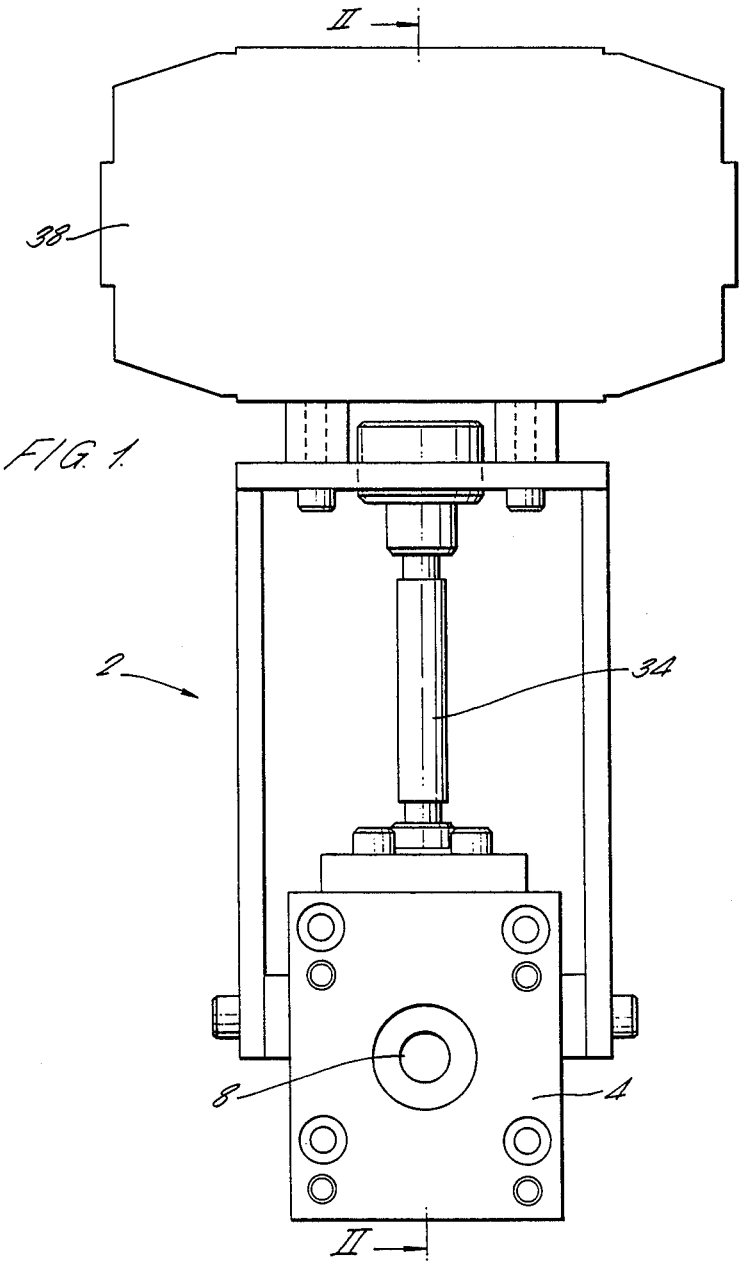
FIG. 1 is a side elevation of a flow valve constructed according to the invention.

Referring to the drawings a flow valve indicated generally by 2 includes a housing 4 having a chamber 6 therein. The chamber 6 contains an upper valve member 24 having a flat surface 17 on its lower side and a lower valve member 7 having a flat surface 5 on its upper side. Inlet and outlet passages 8 and 10 extend through the housing 4 from the opposite sides 12 and 14 thereof to open into diametrically spaced parts 19 and 21 of the base of the chamber 6.

The lower valve member 7 makes a close fit in the chamber 6. It is located on the base of the chamber 6 by location pegs (not shown) protruding therefrom and received by corresponding holes (not shown) in the base of valve member 7. The valve member 7 is bedded onto a layer of ceramic putty which hardens as the valve is heated prior to use and secures the valve member 7 in place. A threaded hole 18 is provided through the centre of valve member 7. This is used if the valve member 7 has to be removed from the chamber 6; a bolt or screw being screwed down through it to push the valve member 7 up from the base of the chamber 6. The lower valve member 7 has two passages 20 and 22 extending therethrough from the diametrically spaced openings 19 and 21 to openings 23 and 25 in the flat surface 5.

Figure 2:
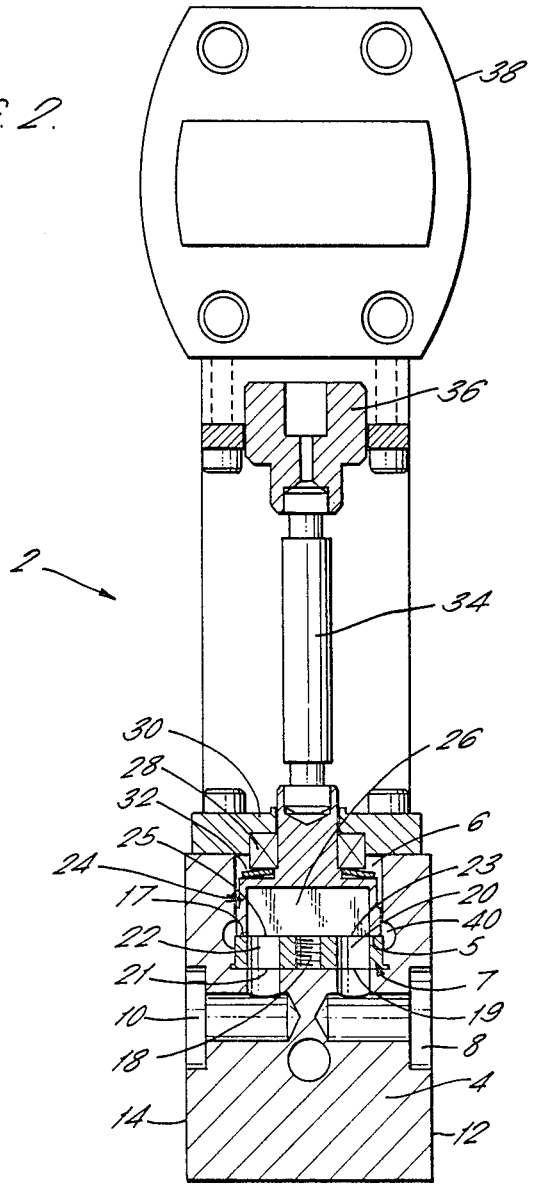
FIG. 2 is a sectional elevation of the valve of FIG. 1 on the section line II—II.

The upper valve member 24 makes a rotatable fit in the chamber 6 and has an elongate intermediate passage 26 therein. This passage 26 has its length extending along the diameter of the valve member 24 to the diametrical outer edges of the openings 23 and 25. The width of the passage 26 is the same as the diameter of the openings 23 and 25. The intermediate passage 26 is open at its lower face into the flat surface 17 so as to communicate with the openings 23 and 25 when in the "valve open" position illustrated in FIG. 2.

The upper valve member 24 is rotatably mounted on the lower valve member 7 by a thrust bearing 28 retained by a cover 30 which is bolted onto the housing 4. The upper valve member 24 is biased into close contact with the lower valve member 7 by a disc spring 32. A coil spring or other biasing means may be employed in place of the disc spring.

The upper valve member 24 is connected by a shaft 34 to a driven member 36 which is operated by a pneumatic actuator 38.

In operation for the production of a melt-out core, the inlet passage 8 is connected to a source of molten core metal and the outlet passage 10, is connected to a mould chamber for a melt-out core. The actuator 38 rotates the upper valve member 24 so that the passages 20 and 22 are connected by the intermediate passage 26 in the upper valve member 24. It will be appreciated that the upper valve member 24 can be rotated so that any desired fraction of the cross section of the passages 20 and 22 can communicate with the passage 26, thereby providing an accurate control of the flow-rate of molten metal into the mould chamber. When the desired quantity of molten metal has entered the mould chamber, the actuator 38 is made to rotate the valve member 24 into the "valve closed" position in which the passage 26 is out of contact with the passages 20 and 22, which are thereby closed by the flat surface 17 of the valve member 24.

In an alternative operational arrangement, the valve member 24 can be rotated by a hydraulic actuator which is computer controlled to provide a desired metal flow rate though the valve for a desired period of time. It is also possible to have a computer controlling a plurality of valves according to the invention.

An annular channel 40 is provided around the periphery of the contacting flat surfaces 5 and 17. The channel is conveniently provided by machining a groove in the wall of the housing 4 surrounding the chamber 6. Any molten metal or dross, for example oxides, escaping between the lower and upper valve members 7 and 24 will be received by this passage. The leaked metal or dross may then leave the valve though one or more leak ports, i.e. passages (not shown) provided through the housing 4. Preferably the leak ports will slope downwardly to facilitate removal of leaked or dross.

It is important that there is a minimum of leakage between the valve member 7 and the valve member 24, and this is achieved partly by biasing these two members together by the disc-spring 32, and partly by ensuring that the flat surface 5 of the valve member 7 and the flat surface 17 of the valve member 24 are machined flat to a high degree of accuracy. In this particular embodiment these upper and lower faces are machined flat to three light bands. Leakage of molten metal should be minimized to ensure that any leaked metal can be accommodated in the annular space 40 to prevent it from solidifying between and jamming the valve members 7 and 24.

In order to prevent wear and seizure of the moving parts and to reduce friction between the valve members 7 and 24, the flat surfaces 5 and 17 are both coated with carbide. These carbide coatings enable the valve to be operated without a lubricant even at the operational temperatures encountered when using molten metal.

A preferred carbide coating comprises 85% tungsten carbide and 15% cobalt by weight. A particular form of such a preferred coating is manufactured by Union Carbide UK Limited under the Ser. No. U.Car LW1-N40. This coating may be applied at high velocity by a detonation gun having an internal temperature of about 3300° C. A typical velocity is 760 m/second. During the application of the coating the surface to which the coating is applied is maintained at a temperature less than or equal to 150° C. After application the coating has a finish thickness of 0.075 to 0.1 mm. The surface is then ground to a surface finish of 0.05 to 0.12 micron. The coating surface then has a surface flatness of less than or equal to 3 light bands.

An important advantage of operating without lubricant is that it reduces the risk of lubricant entering the mould chamber and corrupting the metal of the melt-out core.

The drive arrangement of the shaft 34, the driven member 36 and the pneumatic actuator 38 have a degree of float or play to allow for thermal expansion and minor misalignment.

If desired, one or both of the valve members 7 and 24 may be adapted to receive an orifice plate to control the effective diameter of the inlet, outlet or intermediate passage and thus the effective throughput of the valve.

We claim:

1. A flow valve for controlling molten metal flow comprising first and second valve member having contacting flat surfaces with peripheries, said first valve member containing spaced inlet and outlet fluid passages and said second valve ember containing an intermediate passage for simultaneously communicating with both said inlet and outlet passages in said first valve member, said first and second valve member being mounted such that relative rotation of the flat surfaces can be effected to locate said intermediate passage either fully or partially in or out of communication with said inlet and outlet passages, and including a channel around at least part of the peripheries of said contacting flat surfaces to receive molten metal and dross leaked between them.

2. A flow valve as claimed in claim 1, wherein said channel extends completely around the peripheries of the contacting flat surfaces.

3. A flow valve as claimed in claim 1, wherein said first and second valve members are located in a housing, and wherein said channel is in the form of a groove or recess in said housing.

4. A flow valve as claimed in claim 1, wherein said channel extends below a plane of contact of the flat surfaces of said valve members.

5. A flow valve as claimed in claim 1, wherein said housing includes at least one leak port for removal of material received by said channel.

6. A flow valve as claimed in claim 5 wherein said at least one leak port slopes downwardly.

7. A flow valve as claimed in claim 1 wherein the flat surfaces of the valve members each have a carbide coating.

8. A flow valve as claimed in claim 7 wherein the carbide coating of each surface has a surface flatness of not more than 3 light bands.

9. A flow valve as claimed in claim 1, including a spring acting on one of said first and second valve members to bias said flat surfaces into contact.

10. A flow valve as claimed in claim 9, wherein said spring is a disc spring or a coil spring.

11. A flow valve as claimed in claim 1, wherein at least one of the inlet, outlet and intermediate passages is adapted to receive an orifice plate to control an effective diameter thereof.

* * * * *